United States Patent [19]

Pineau et al.

[11] Patent Number: 4,980,092

[45] Date of Patent: Dec. 25, 1990

[54] METHOD FOR THE DESTRUCTION OF CHEMICALLY STABLE WASTE

[75] Inventors: Didier M. J. M. Pineau, Bordeaux; Yves H. G. Valy, St Medard En Jalles, both of France

[73] Assignee: Aerospatiale Societe Nationale Industrielle, Paris, France

[21] Appl. No.: 336,031

[22] Filed: Apr. 11, 1989

[30] Foreign Application Priority Data

Apr. 22, 1988 [FR] France ..... 88 05389

[51] Int. Cl.[5] ..... G21F 9/08

[52] U.S. Cl. ..... 252/632; 252/630; 252/631; 110/238; 110/246; 110/346; 219/121.48

[58] Field of Search ..... 110/246, 238, 346; 252/630, 631, 632; 219/121.48

[56] References Cited

U.S. PATENT DOCUMENTS

| | | | |
|---|---|---|---|
| 3,841,239 | 10/1974 | Nakamura et al. | 110/8 |
| 4,438,706 | 3/1984 | Boday et al. | 110/346 |
| 4,469,508 | 9/1984 | Amouroux et al. | 75/10 R |
| 4,479,443 | 10/1984 | Faldt et al. | 110/346 |
| 4,509,434 | 4/1985 | Boday et al. | 110/238 |
| 4,770,109 | 9/1988 | Schlienger | 110/247 |
| 4,831,944 | 5/1989 | Durand et al. | 110/346 |

FOREIGN PATENT DOCUMENTS

| | | |
|---|---|---|
| 105866 | 9/1983 | European Pat. Off. . |
| 2113815 | 8/1983 | United Kingdom . |
| 2152949 | 6/1984 | United Kingdom . |

OTHER PUBLICATIONS

Groo, Jean-Paul, Revue Generale de L'Electricite, No. 8, (Sep. 1987), pp. 156 to 162.

*Primary Examiner*—Edward A. Miller
*Assistant Examiner*—Ngoclan T. Mai
*Attorney, Agent, or Firm*—Fisher, Christen & Sabol

[57] ABSTRACT

A method for the destruction of chemical stable waste by pyrolysis whereby heat is applied to the waste using at least one plasma torch formed of non-transferred arc plasma type. The waste generated inside a duct having an end orifice flows upward passing the orifice and toward the nozzle of the plasma torch, wherein the axis of the nozzle of the plasma torch and the axis of the orifice are substantially collinear. Gaseous and/or liquid waste products resulting from the heating step are subjected to expansion and combustion in the combustion chamber whereby gaseous products resulting from combustion and expansion are quenched and then washed.

10 Claims, 5 Drawing Sheets

METHOD FOR THE DESTRUCTION OF CHEMICALLY STABLE WASTE

BACKGROUND OF THE INVENTION

1. Field of the Invention

The present invention relates to a method and device for the destruction of chemically stable waste and particularly radioactive waste and/or waste presenting considerable danger for the environment and living beings.

2. Description of the Prior Art

Devices are already known, for example from patents US-A-3 841 239, EP-A-105 866 and EP-A-112 325, for the destruction of waste by pyrolysis using at least one plasma torch. In these known devices, the waste is brought, generally from top to bottom by the action of gravity, to a zone heated by said torches, disposed laterally with respect to the path taken by the waste.

Such devices do not permit an optimum transfer of energy from the plasma to the waste, so that some particularly stable wastes, such as cyanided organic and organo-chlorinated waste, cannot be processed using known plasma devices. Thus, this waste, which is particularly dangerous, must be stored deep in the ground, for example in salt mines, or else in warehouses, while waiting for the discovery of a method for eliminating it.

SUMMARY OF THE INVENTION

The purpose of the present invention is to provide a method and device for the total destruction by pyrolysis of the most stable wastes.

For this, in accordance with the invention, the method for the destruction of chemically stable waste by pyrolysis by means of at least one plasma torch is remarkable in that :

said torch is of the non transferred arc plasma type;

the nozzle of the torch is directed towards an orifice, so that the axis of said nozzle and the axis of said orifice merge at least approximately; and a flow of said waste is caused to pass through said orifice, so that it advances towards said torch.

By "non transferred arc plasma torch" is here meant, which is the usual meaning, a plasma torch comprising two fixed electrodes, to which the feet of the arc cling.

Thus, in accordance with the invention, the plasma tongue attacks, endwise (and not transversely as in the prior technique), the flow of waste passing through said orifice. Consequently, the transfer of heat energy is optimum and very stable substances can be destroyed, such as cyanided organic or organo-chlorinated compounds.

Experience has shown that it is advantageous, in so far as heat transfer is concerned, for the diameter of said orifice to be a little greater, about 2 to 3 times, than the diameter of the nozzle of said torch.

In fact, the whole cross section of the flow of waste passing through said orifice is thus subjected to the action of the plasma tongue. Thus, by adjusting the energy of the plasma torch, the distance between said torch and said orifice and/or the speed of advance of said flow of waste through said orifice, the amount of energy per unit of time received by said waste through said orifice may be regulated, i.e. the quality of destruction of said waste.

In an advantageous embodiment of the invention, the axes, which merge at least approximately, of said nozzle and of said orifice are at least approximately vertical and the flow of waste moves, at least in the vicinity of said orifice, from bottom to top. In this case, the tongue of the plasma torch is therefore directed downwards.

When, in addition, said orifice is the end of a tubular waste injector, it can be seen that the upper part of said injector may serve as crucible for the end portion of said flow of waste, which is in the liquid state.

Preferably, said nozzle and said orifice are disposed in an expansion chamber, in which are burned the gases coming from the liquid end of the flow of said waste. Means may be provided for introducing oxygen and/or energy inside said expansion chamber, so as to facilitate combustion of said gases.

In a variant of the invention, the axes, at least approximately merged, of said nozzle and of said orifice are slightly slanted with respect to the vertical, in the direction of said expansion chamber, so that a portion of the liquid end of said flow of waste may flow into said expansion chamber, this liquid end portion is then processed and burnt in said expansion chamber, possibly with an additional supply of oxygen and/or energy.

Whatever the condition, liquid or gaseous, of the waste when it is introduced into the expansion chamber, there only remains a gas phase at the downstream portion of said expansion chamber. If required, in order to prevent liquid waste particles being projected too far inside said expansion chamber by the plasma tongue, which would adversely affect the quality of combustion of said liquid particles and their transformation into gas, baffles may be provided inside said expansion chamber, just opposite said nozzle and said orifice. Such an expansion chamber may be a rotary oven.

Because of the quality of the pyrolytic process used by the present invention ,before being discharged to the atmosphere and/or used as a heat source, the gases resulting from combustion in the expansion chamber may be subjected only to a simple processing. Preferably, they are simply washed in a washing tower, after having undergone thermal quenching.

The waste to be destroyed by the practice of the present invention may, initially, be in gaseous or liquid form. However, it may also be in solid form.

For this, in order to supply said orifice with a flow of waste, a process may be provided for transforming said solid waste into a paste extrudable through said orifice. Such a process may comprise shredding, crushing and/or wetting. The paste may then be driven by pumping means.

Preferably, between said pumping means and said orifice a guide duct, in the form of a siphon, is provided for the flow of waste to be destroyed. Thus, any rise of gas is prevented in the direction of said pumping means.

BRIEF DESCRIPTION OF THE DRAWINGS

The figures of the accompanying drawings will better show how the invention may be put into practice. In these figures, identical references designate similar elements.

DESCRIPTION OF THE PREFERRED EMBODIMENTS

Figure 1:
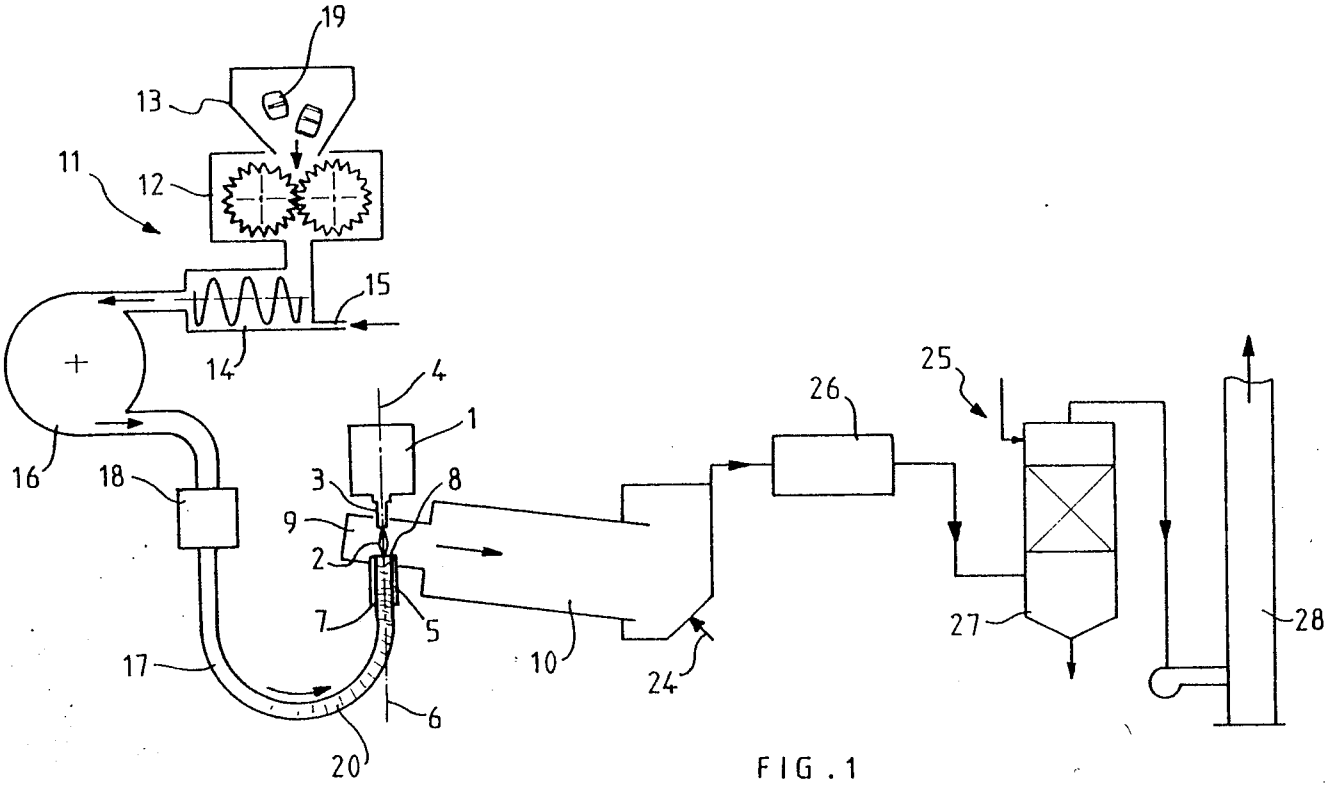
FIG. 1 is a block diagram of one embodiment of the device of the present invention.

The device, according to the invention and shown in FIG. 1, comprises a plasma torch 1 capable of emitting a plasma tongue 2 from its nozzle 3. This torch is of the known non transferred arc type. In a way known per se and not shown, it may comprise two coaxial cooled tubular electrodes which are joined by a plasmagene gas injection chamber and an element providing electric insulation of the two electrodes. Rotation of the arc foot may be provided by a magnetic field coil for the upstream electrode and by the action of the vortex in the downstream electrode. The rated operating characteristic of the torch may be 500 electric kW and adjustment of the power of the torch is preferably continuous between 250 kW and 500 kW.

The plasma torch 1 is disposed so that its axis 4 is at least substantially vertical, the nozzle being directed downwards. Opposite the nozzle 3, the device of FIG. 1 comprises a tubular injector 5, whose axis 6 is at least substantially vertical and merges with the axis 4 of torch 1. The tubular injector 5 is fed with waste to be destroyed through its lower end 7. This waste leaves said tubular injector 5 through the upper orifice 8 thereof, disposed opposite nozzle 3. Preferably, the diameter D of the tubular injector 5 is equal to a few times (2 or 3) the diameter d of nozzle 3. In one embodiment, the diameter D of tubular injector 5 was equal to 100 mm.

At least the lower portion of nozzle 3 and the upper portion of the tubular injector 5 are disposed in a tap-hole system 9, giving access to a gas expansion chamber 10.

The embodiment of the device of the invention, shown in FIG. 1, is intended particularly for the destruction of solid waste. The waste to be destroyed is for example contained in barrels and, in order to reduce the cost of processing said waste, the device of FIG. 1 permits destruction of said barrels at the same time as the waste they contain.

For this, the device comprises a means 11 for prior processing of said waste comprising a crushing-shredding machine 12 fed from a hopper 13 and with which a finishing shearing machine (not shown), a mixing and compacting machine 14 having a fluid intake 15 and a pump 16 may be possibly associated.

The output of pump 16 is connected to the lower portion 7 of tubular injector 5 through a guide duct 17 forming a siphon. Preferably, a safety member 18, for example a guillotine shut-off valve, is provided between pump 16 and guide duct 17.

The barrels 19 of waste to be destroyed are introduced into hopper 13 and brought to the crushing-shredding machine 12, whose knives seize, shear, tear and compress said barrels and their contents The finishing shearing machine, if provided, reduces the final grain size of the crushed material to a size which is, for example, 10 × 20 mm at most.

The whole of the process takes place in cascade fashion by gravity, without manual intervention, relatively slowly so as to avoid any production of sparks likely to ignite the product. Furthermore, the whole of the equipment may be placed under air depression, so as to avoid any escape of toxic gases.

The crushed material, thus reduced in size, flows by gravity to the mixing and compacting machine 14 whose role is to compact the material (the pasty portions with foreign substances) by pushing it into the transfer pump 16.

The pump 16 is for example of the known type (PUSTMASTER) with hydraulic jacks and provides a regular flow of the heterogeneous mixture and at high pressure (80 to 100 bars), thus ensuring excellent compacting.

It is possible to add to the mixer 14, through the inlet 15, either water, or oily products which it is desired to be rid of, so as to improve the pumpability of the crushed material and its power to keep its shape.

Thus, at the outlet of pump 16, the crushed waste (with its containers) is in a pasty form. Pump 16 pushes this pasty material (through the safety member 18) into the guide duct 17 as far as tubular injector 5. In the guide duct 17 and tubular injector 5, the pasty material thus forms a sausage 20 which advances in the direction of nozzle 3.

The siphon shape of the guide duct 17 avoids any rise of liquid or gas towards pump 16.

Figure 2:
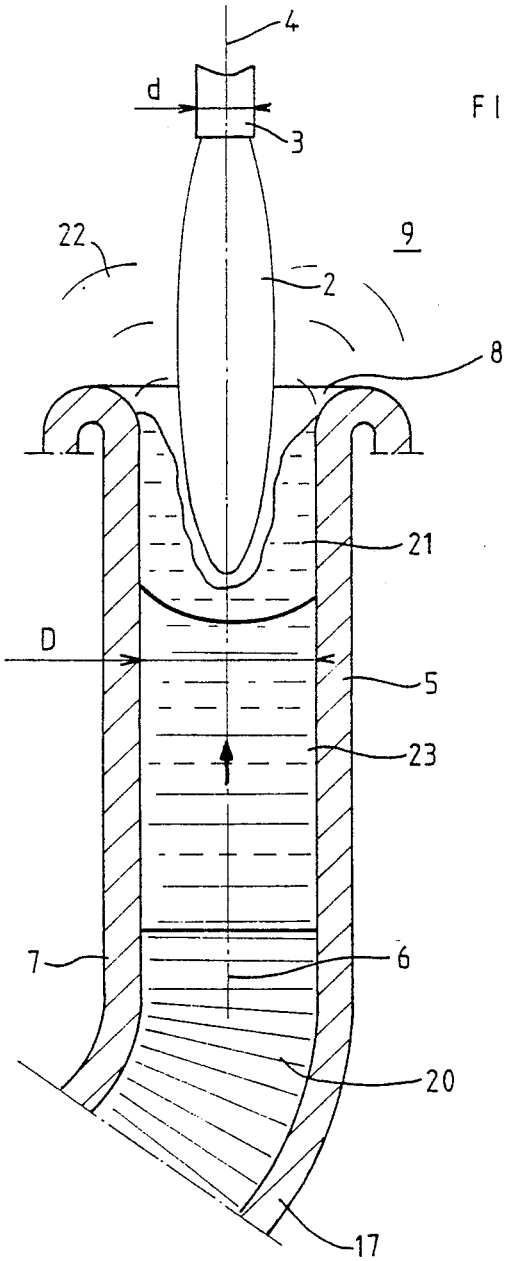
FIG. 2 illustrates the operating procedure of the device of FIG. 1.

In the injector 5, the sausage 20 travels from bottom to top and its upper end portion is subjected to the action of the plasma tongue 2, which attacks on end (see FIG. 2). Thus, the upper portion of sausage 20, constantly renewed, is nibbled away by the plasma tongue 2 (whose temperature is of the order of 4000 to 5000° C.) and passes into the molten liquid phase (see reference 21), which itself gives rise to a gas phase 22 in the tap-hole system 9. A semi-molten intermediate pasty phase 23 is established between the upper zone 21 of the liquid phase and the pasty sausage 20.

It will be noted that the liquid phase of zone 21 forms a sort of crucible forming a heat and chemical protection for tubular injector 5.

The gas phase 22 appearing in the tap-hole system 9 is discharged to the expansion chamber 10, in which it finishes being completely destroyed under the effect of the temperature which prevails therein (for example about 1800° C.). Self combustion takes place, which may be promoted by the introduction of air or oxygen (at 24). The expansion chamber 10 may be designed for the substoichiometric combustion of the chlorinated liquid effluents and it may be provided with an internal lining of the "CHROMCOR" type.

With the coaxial arrangement of nozzle 3 and tubular injector 5, the upper free end of sausage 20 is in intimate and extended contact with the tongue 2 and, in the vicinity of the upper orifice 8 of said injector 8, undergoes a very high temperature rise; the molecules of the material of the pasty sausage are then completely dissociated into more or less ionized elementary particles.

The combustion gases generated in the expansion chamber are processed by a system 25 which, because of the excellent performances of the device of the invention, need not be complicated. Thus, the system 25 may comprise a quenching device 26 for lowering the temperature of the gases followed by a washing tower 27.

Thus, the residual products, such as chlorine for example, are neutralized and the gases may then be led to a chimney 28, for discharge to the atmosphere.

These gases may, if required, be introduced into a boiler for energy recovery.

In the variant of construction of the device of the invention, illustrated in FIG. 3, we find again the different elements 1 to 18 and 25 to 28 described above. However, in this case, the merging axes 4 and 6, of torch 1 and injector 5, are slanted with respect to the vertical so that at least a portion 29 of the liquid phase 21 of sausage 20 (see FIG. 2) may flow into the expansion chamber 10. It is then advantageous for the latter to be in the form of an inclined rotary oven 30, capable of stirring the non gaseous elements coming from injector 5 and which will be destroyed during their journey to the low downstream portion of said rotary oven 30, because of the high temperature prevailing in said rotary oven 30. To facilitate such destruction, pressurized air may be introduced (at 31) therein. Burners (not shown) may also be provided for supplying additional energy (shown symbolically by arrow 32) to the rotary oven.

The downstream portion 33 of the rotary oven 30 then forms a post-combustion chamber for the gaseous products In this post-combustion chamber, there are no longer any non gaseous products.

Figure 3:
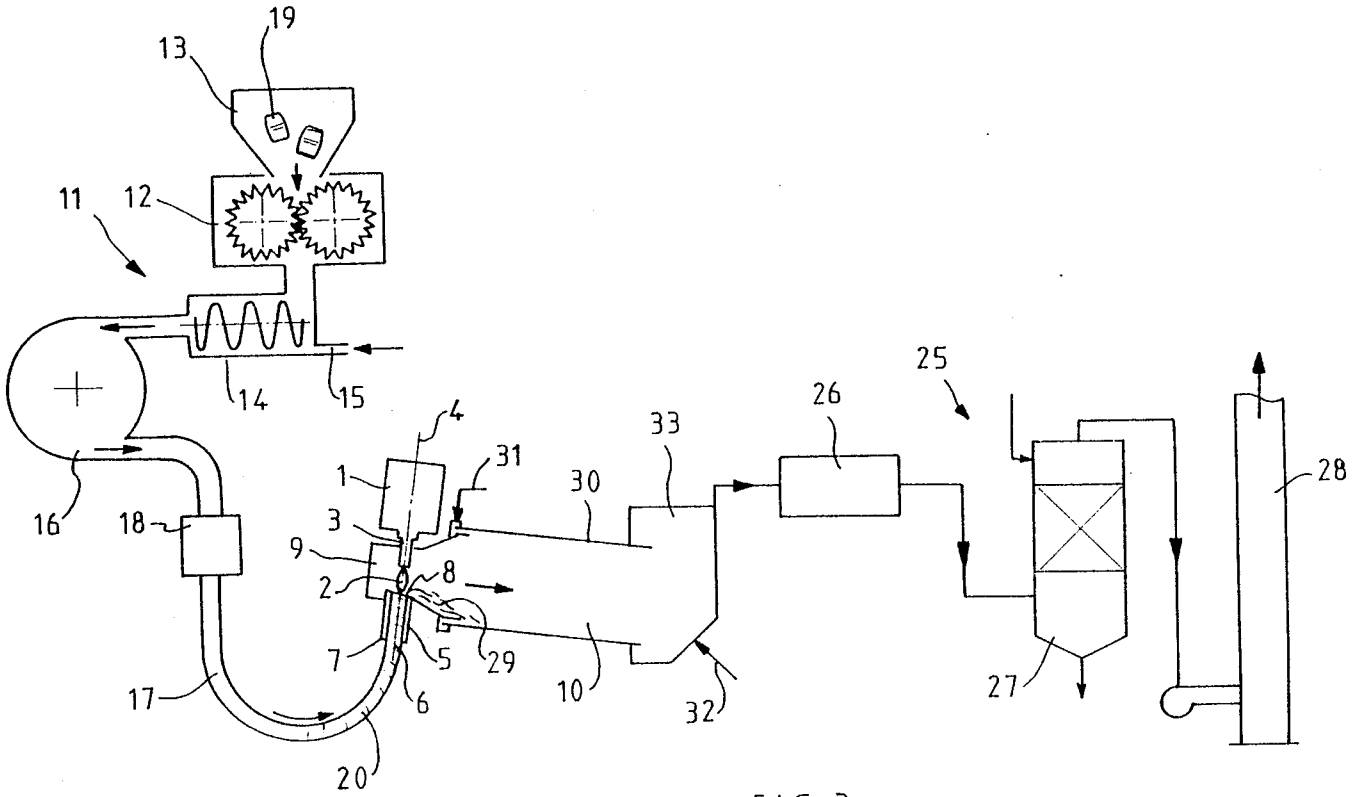
FIG. 3 shows schematically a variant of construction of the device of FIG. 1.
Figure 4:
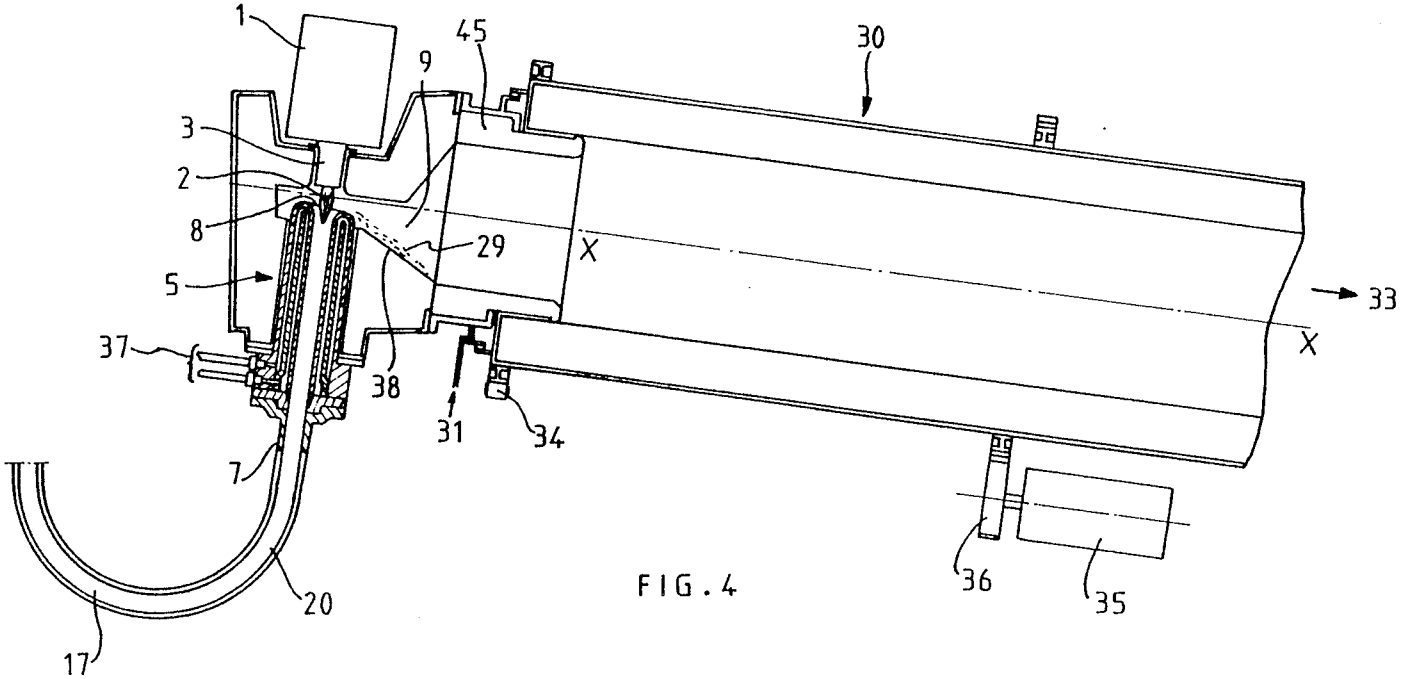
FIG. 4 illustrates in section, and in greater detail, a portion of the device of FIG. 3.

In FIG. 4, an industrial embodiment of the device of FIG. 3 has been shown partially. We can see therein the rotary oven 30, whose longitudinal axis X—X is slanted downwards from the tap-hole system 9 towards the post-combustion chamber 33, so as to facilitate the flow (during which they will be completely gasified) of the molten material 29, from upstream to downstream. This rotary oven is supported by rollers 34 and is rotated by a motor 35, through a rotating roller 36. The connection between the tap-hole system 9 and the rotary oven 30 is provided by a fixed adapter 45.

FIG. 4 also shows that the injector 5, for example made from tantalum, has a double wall structure, inside which cooling fluid may flow. For this, said injector 5 is connected to a cooling fluid flow circuit 37.

In a way known per se and not shown, a cooling unit, a plasmagene gas production unit (e.g. air) and an electric power supply are associated with the plasma torch 1.

The bottom 38 of the tap-hole system 9 may be slanted so as to promote flow of the molten material 29 towards the rotary oven 30.

It will be readily understood from the foregoing that the quality of destruction of the waste contained in sausage 20 may be regulated by adjusting the advancing speed thereof, the power of torch 1 and/or the distance separating tongue 2 from the orifice 8 of injector 5.

The advancing speed of sausage 20 is obviously controllable by controlling pump 16. Similarly, the power of torch 1 is adjustable electrically in a way known per se.

Figure 5:
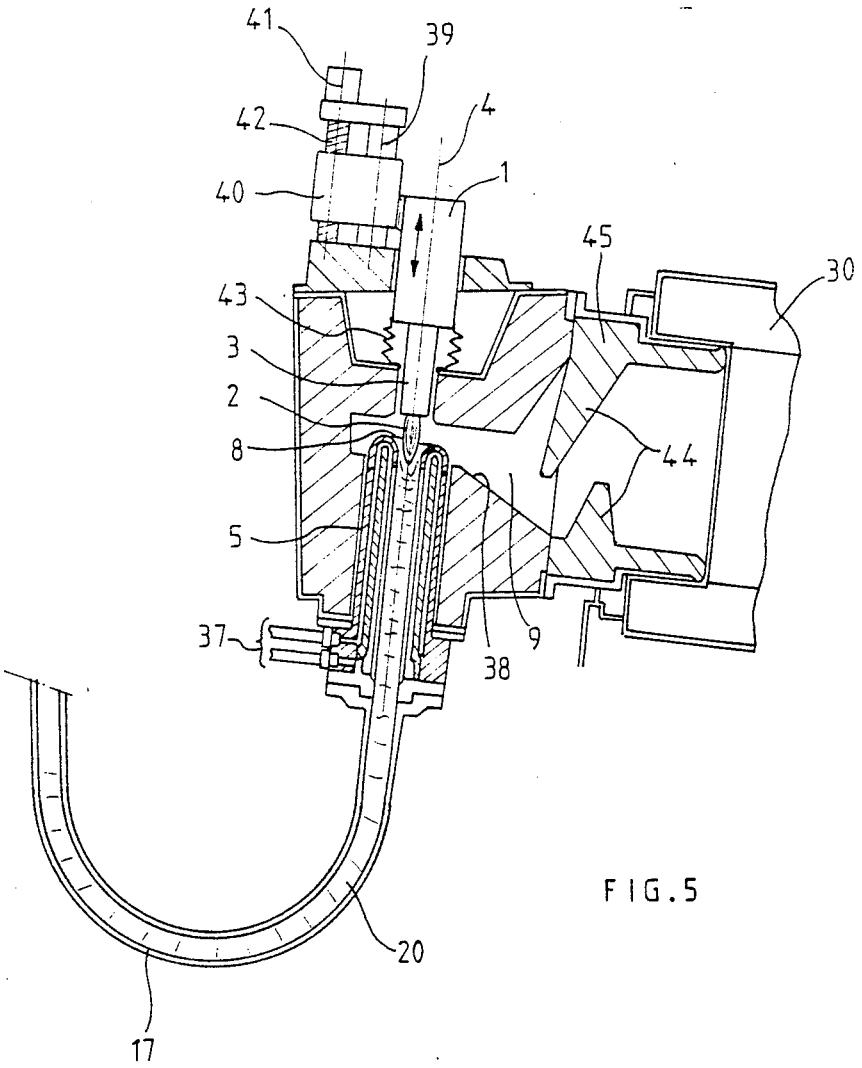
FIG. 5 is a partial section of another variant of construction.

In so far as the variation of the distance between tongue 2 and orifice 8 is concerned, an appropriate device has been shown in FIG. 5. The torch 1 is mounted for sliding along its axis 4; in its sliding, it is guided by a column 39 with which a slide 40 cooperates. Slide 40 is movable by a motor 41 and screw 42 system. A bellows provides sealing between torch 1 and the tap-hole system 9.

Furthermore, in the device shown in FIG. 5, deflectors 44 have been provided, forming baffles, disposed in the adapter 45, for preventing the projection of particles, torn away from sausage 20 by the plasma, to too great a distance inside said oven. The deflectors 44 thus make it possible for the particles to be processed as close as possible to the plasma jet.

What is claimed is:

1. A method for destroying chemically stable waste by pyrolysis, comprising the steps of:

(a) generating a flow of waste inside a duct having an end orifice, said flow of waste passing through said orifice; and (b) directing the tongue of a non-transferred arc plasma torch towards said orifice, the axis of the nozzle of said plasma torch and the axis of said orifice being substantially collinear.

2. The method as claimed in claim 1, wherein the diameter of said orifice is equal to a few times the diameter of the nozzle of said torch.

3. The method as claimed in claim 1, wherein at least the distance between said torch and said orifice is adjustable.

4. The method as claimed in claim 1, wherein the axes of said nozzle and of said orifice are substantially vertical and wherein at least in the vicinity of said orifice, said waste flows upwards.

5. The method as claimed in claim 1, wherein gaseous and/or liquid products resulting from the action of said torch on said flow of waste are subjected to expansion and combustion.

6. The method as claimed in claim 1, wherein the diameter of said orifice is equal to two or three times the diameter of the nozzle of said torch.

7. The method as claimed in claim 1, wherein the axes of said nozzle and of said orifice are slanted with respect to vertical.

8. The method of claim 5, wherein the movement of the gaseous and/or liquid products resulting from the action of said torch on said flow of waste is limited by baffles disposed within the combustion chamber and opposite to said nozzle and said orifice, whereby said products are not projected too far from the tongue of said plasma torch.

9. The method as claimed in claim 5, wherein said gaseous products resulting from said expansion and said combustion are quenched, then washed.

10. The method as claimed in claim 1, applied to solid waste, wherein said solid waste is transformed into paste extrudable through said orifice.

* * * * *